United States Patent [19]

Yamaguchi et al.

[11] Patent Number: 4,860,708

[45] Date of Patent: Aug. 29, 1989

[54] THROTTLE CONTROL SYSTEM FOR AUTOMOTIVE INTERNAL COMBUSTION ENGINE

[75] Inventors: Kouji Yamaguchi; Yoshikazu Ishikawa; Toshihiro Kameda; Shogo Hattori; Junichi Miyake, all of Wako, Japan

[73] Assignee: Honda Giken Kogyo Kabushiki Kaisha, Tokyo, Japan

[21] Appl. No.: 200,988

[22] Filed: Jun. 1, 1988

[30] Foreign Application Priority Data

Jun. 3, 1987 [JP] Japan ..... 62-86789

[51] Int. Cl.[4] ..... F02D 11/10

[52] U.S. Cl. ..... 123/399; 123/400

[58] Field of Search ..... 123/339, 361, 399, 400

[56] References Cited

U.S. PATENT DOCUMENTS

| | | | |
|---|---|---|---|
| 4,508,078 | 4/1985 | Takeuchi et al. | 123/399 |
| 4,601,271 | 7/1986 | Ejiri et al. | 123/399 X |
| 4,660,520 | 4/1987 | Inoue et al. | 123/399 |
| 4,703,823 | 11/1987 | Yogo et al. | 123/399 X |
| 4,727,837 | 3/1988 | Sturdy | 123/399 X |
| 4,747,380 | 5/1988 | Ejiri et al. | 123/399 |
| 4,787,353 | 11/1988 | Ishikawa et al. | 123/400 X |

*Primary Examiner*—Willis R. Wolfe

*Attorney, Agent, or Firm*—Armstrong, Nikaido, Marmelstein, Kubovcik & Murray

[57] ABSTRACT

A control system for a throttle valve in automotive internal combustion engines in which the throttle valve is both mechanically linked with an accelerator pedal and also connected with an actuator such as a pulse motor for fine-adjusting the opening of the throttle valve in the closing direction in accordance with the operating state of the engine after it has been opened through the mechanical linkage. A spring is inserted in the mechanical linkage system between the accelerator pedal and the throttle valve. The provision of the spring substantially isolates the accelerator pedal from forces acting in other parts of the system so that the operator does not feel an unnatural change in the amount of pressure needed to depress the accelerator pedal when the actuator goes into operation.

7 Claims, 5 Drawing Sheets

THROTTLE CONTROL SYSTEM FOR AUTOMOTIVE INTERNAL COMBUSTION ENGINE

BACKGROUND OF THE INVENTION

1. Field of the Invention

This invention relates to a throttle control system for automotive internal combustion engines, more particularly to a system for controlling opening of a throttle valve of automotive internal combustion engines in which the throttle valve is not only mechanically linked with the accelerator pedal but also connected with an actuator so as to be openable and closable thereby, and still more particularly to such a system which prevents deterioration in accelerator pedal feeling caused by change in the amount of accelerator pedal depression force required when the actuator is in operation, namely eliminates any unnatural or unpleasant feeling the operator might otherwise experience because of change in the amount of foot pressure required to depress the accelerator pedal.

2. Description of the Prior Art

In most automobiles and other vehicles powered by internal combustion engines, the throttle valve of the internal combustion engine is mechanically linked with an accelerator pedal so that the operator can open and close the throttle valve by varying the amount of depression of the accelerator pedal. However, there has recently been proposed another arrangement wherein an actuator, e.g. a motor, linked with the throttle valve drives the throttle valve in the required direction according to the amount of accelerator pedal depression detected. A system of this type is disclosed, for example, in Japanese Laid-open Patent Application No. 59(1984)-99045.

There are also known systems that combine the arrangements just mentioned. In these, in addition to the throttle valve being mechanically linked to the accelerator pedal, it is also connected with an actuator, and the throttle valve is opened and closed by both the accelerator pedal and the actuator. An example of such a system is shown in FIG. 7. In the illustrated arrangement, the throttle valve is linked both with the accelerator pedal, mechanically by a wire or the like, and with a pulse motor such that after the throttle valve has been opened by a certain amount by the action of the accelerator pedal, the degree of opening can be finely adjusted by the closing action of the pulse motor. This is advantageous in that it enables the throttle valve to zero in on an optimum degree of opening for, by way of example, realizing optimum fuel economy.

To be more specific, the throttle valve 12 provided in an air intake passage 10 is fixed to a throttle valve shaft 14 so that the air intake passage can be opened and closed by rotation of the shaft 14, thereby adjusting the amount of intake air in the known manner. A portion of the throttle valve shaft 14 extends to the exterior of the air intake passage 10 at either side thereof and a throttle drum 16 is fit on the external portion on one side through a collar so as to be free to rotate thereon. The throttle drum 16 is mechanically linked with an accelerator pedal 22 via a wire 18 and a linkage mechanism 20 in such manner that when the operator depresses the accelerator pedal 22, the throttle drum 16 rotates in the direction of the arrow a, i.e. counterclockwise as seen in the figure. The shaft 14 further has a throttle lever 24 rigidly fixed thereon adjacent to the throttle drum 16 and a lost motion spring 26 is mounted between the throttle drum 16 and the throttle lever 24. When the throttle drum 16 is rotated counterclockwise, i.e. in the direction of arrow a, owing to depression of the accelerator pedal 22, the spring 26 causes the throttle lever 24 to follow this motion, i.e. to rotate in the same direction up to the point that a bar **24*b* extending laterally from an arm 24*a* of the throttle lever 24 abuts against an arm 16*a* of the throttle drum 16. This rotation of the throttle lever 24 is transferred to the throttle valve shaft 14 and causes the throttle valve 12 to open. In addition, a return spring 28 is mounted on the shaft 14 between the throttle lever 24 and a projection 10*a* on the air intake passage 10, which urges the throttle valve 12 in the closing direction. The return spring 28** is provided as a fail safe means in a case when no force acts on the throttle valve or the throttle valve shaft.

The end of the shaft 14 outward from the throttle drum 16 has a throttle valve closing lever 30 mounted thereon via a collar 32 so as to be freely rotatable with respect to the shaft 14. When the throttle valve closing lever 30 rotates clockwise as indicated by the arrow b, a bar **30*b* extending laterally from an arm 30*a* thereof engages with a second bar 24*d* extending laterally from a second arm 24*c* of the throttle lever 24, causing the throttle lever 24 to rotate clockwise as indicated by the arrow c and thereby closing the throttle valve 12. The throttle valve closing lever 30 has a second arm 30*c*, extending to the opposite direction to the first arm 30*a*, which is linked via a connection rod 34 to one end of a boomerang-shaped lever 40 attached to the drive shaft 38 of a pulse motor 36. When the pulse motor 36 rotates in the forward and reverse directions between the positions at which the motor lever 40 abuts against a stop 42, the throttle valve closing lever 30 is rotated in one direction or the other accordingly. For example, when the connection rod 34 is moved in the direction of the arrow d, the throttle valve closing lever 30 rotates in the direction of the arrow b. The pulse motor 36 is controlled by a control unit 50 which computes a control value based on signals received from a throttle opening sensor 52 which is disposed on the portion of the shaft 14 extending on the other side of the air intake passage 10 and detects the degree of opening of the throttle valve 12, from an accelerator pedal depression sensor 54 located in the vicinity of the accelerator pedal 22 for detecting the amount of depression of the accelerator pedal, an intake air pressure sensor 56 disposed at an appropriate location within the air intake passage 10 downstream of the throttle valve 12 for detecting the pressure in the air intake passage as an absolute value, and a crankshaft angle sensor 58 located in the vicinity of a rotating member, not shown, of the internal combustion engine for detecting the angular position of the engine crankshaft. The computed control value is used to control the operation of the pulse motor 36**.

In the arrangement shown in FIG. 7, the torque acting on the throttle valve shaft 14 is required to be:

$$M > L - B > C$$

wherein M is the torque produced by the pulse motor 36, L is the maximum torque of the lost motion spring 26, B is the maximum torque of the return spring 28 and C is a constant. In the formula, if the constant C is set too low, the throttle valve will be incapable of properly assuming the fully opened state, whereas if it is set too high, the accelerator pedal feeling will be degraded. The constant should therefore be determined appropriately. Moreover, regardless of the value at which it is set, it is clear from the foregoing relationship that the valve closing force B of the return spring 28 has to be larger than the constant and that the force L of the lost motion spring 26 must be greater than the return spring force such that the lost motion spring can cause the throttle lever 24 to follow the counterclockwise rotation of the throttle drum 16 thereby opening the throttle valve 12.

Thus, the throttle valve 12 is urged in the closing direction by the return spring 28 and the force of this spring 28 is transmitted through the lost motion spring 26, the wire 18, etc. to the accelerator pedal 22 where it constantly acts as a force opposite to the pedal depression force applied by the operator. In the prior art system, therefore, once the accelerator pedal 22 has been depressed to cause the throttle drum 16 to rotate counterclockwise as indicated by the arrow a and the throttle lever 24 follows this rotation under the force of the lost motion spring 26 thus opening the throttle valve 12, if the pulse motor 36 then rotates in the forward direction so that the connection rod 34 is moved in the direction of the arrow d, the throttle valve closing lever 30 is rotated clockwise as indicated by the arrow b, the throttle lever 24 is rotated clockwise as indicated by the arrow c counter to the force of the spring 26 by force received via the bar 30*b* and the bar 24*d* engaged, and the throttle valve 12 is thus rotated in the closing direction, the result will be that the force of the spring 26 will be added to that of the return spring 28, causing the amount of force required to depress the accelerator pedal 22 to change stepwise as shown in FIG. 8 and this will degrade the accelerator pedal feeling and cause the operator to experience an unnatural or uncomfortable sensation. It should be noted that the force of the return spring 28 for urging the throttle valve 12 in the closing direction is required to be relatively large and the force of the spring 26 has to be even larger in order to be able to overcome its force and open the throttle valve as stated before with reference to the formula. Thus, combined force of the two springs, which causes intermittent variation in the required amount of accelerator pedal depression force, is too large to be ignored.

SUMMARY OF THE INVENTION

It is therefore an object of the invention to provide a throttle control system for automotive internal combustion engines which overcome the drawbacks of the prior art.

Another object of the invention is to provide such a system wherein the amount of force required to depress the accelerator pedal does not substantially vary depending on whether or not an actuator is in operation.

For realizing the aforesaid objects, the invention provides a system for controlling the degree of opening of a throttle valve disposed in an air intake passage of an internal combustion engine mounted in a vehicle, including a rotatable shaft for rigidly supporting said throttle valve in the air intake passage, first spring means for urging said shaft in the direction in which said throttle valve closes said air intake passage, an accelerator pedal disposed adjacent at the operator's seat in the vehicle and linked with said shaft, second spring means for urging said shaft in the opposite direction in which said throttle valve opens said air intake passage when said accelerator pedal is depressed, force of said second spring means being greater than that of said first spring means and a motor connected to said shaft for driving said shaft in the valve closing direction counter to the force of said second spring means when actuated. In the system a third spring means is disposed in the linkage between said shaft and said accelerator pedal for urging said shaft in the valve closing direction in cooperation with said first spring means.

BRIEF DESCRIPTION OF THE DRAWINGS

These and other objects and advantages of the invention will be more apparent from the following description made and drawings, in which.

DESCRIPTION OF THE PREFERRED EMBODIMENT

Figure 1:
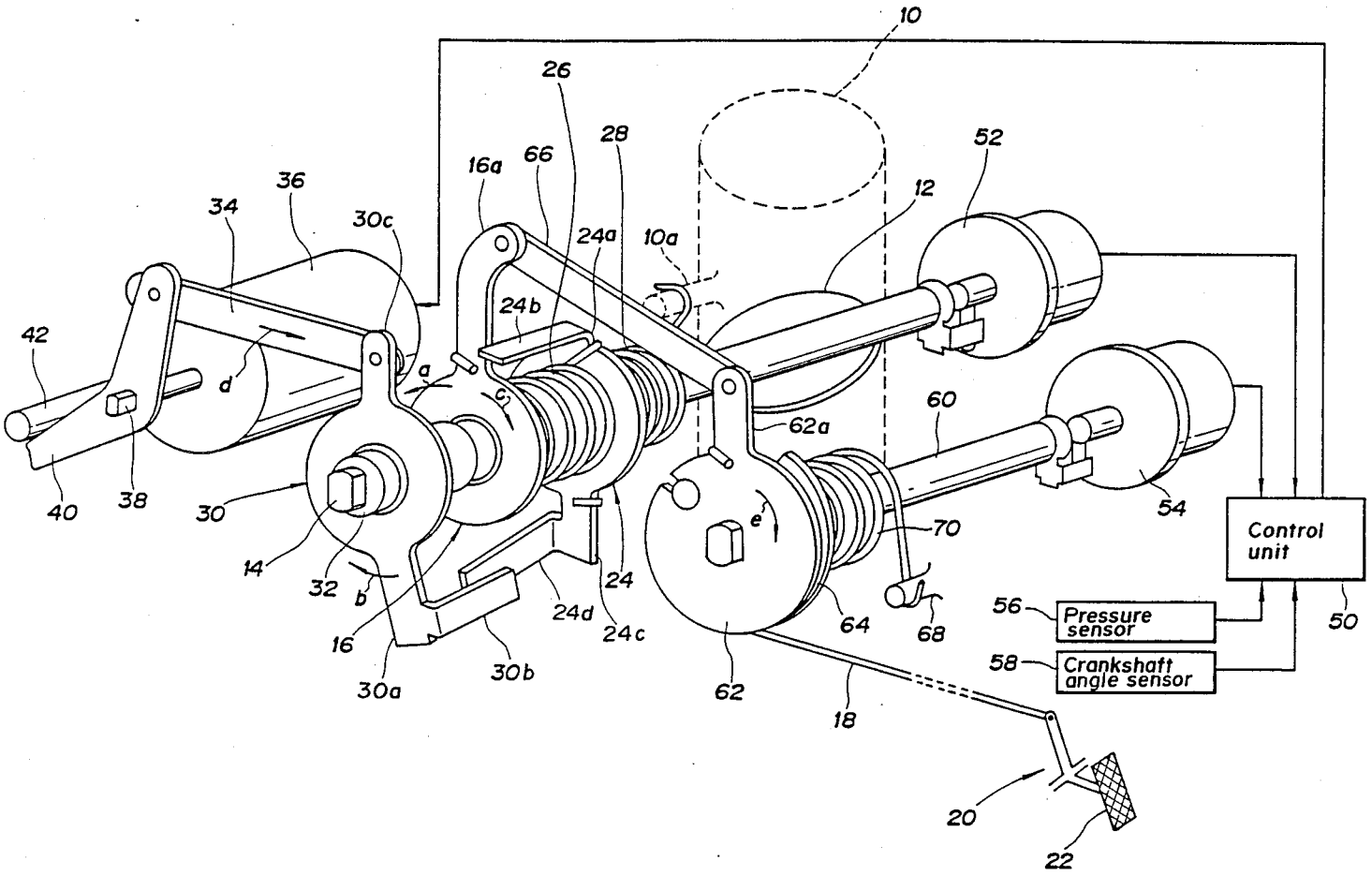
FIG. 1 is an overall perspective view of a throttle control system for an automotive internal combustion engine according to the present invention.
Figure 7:
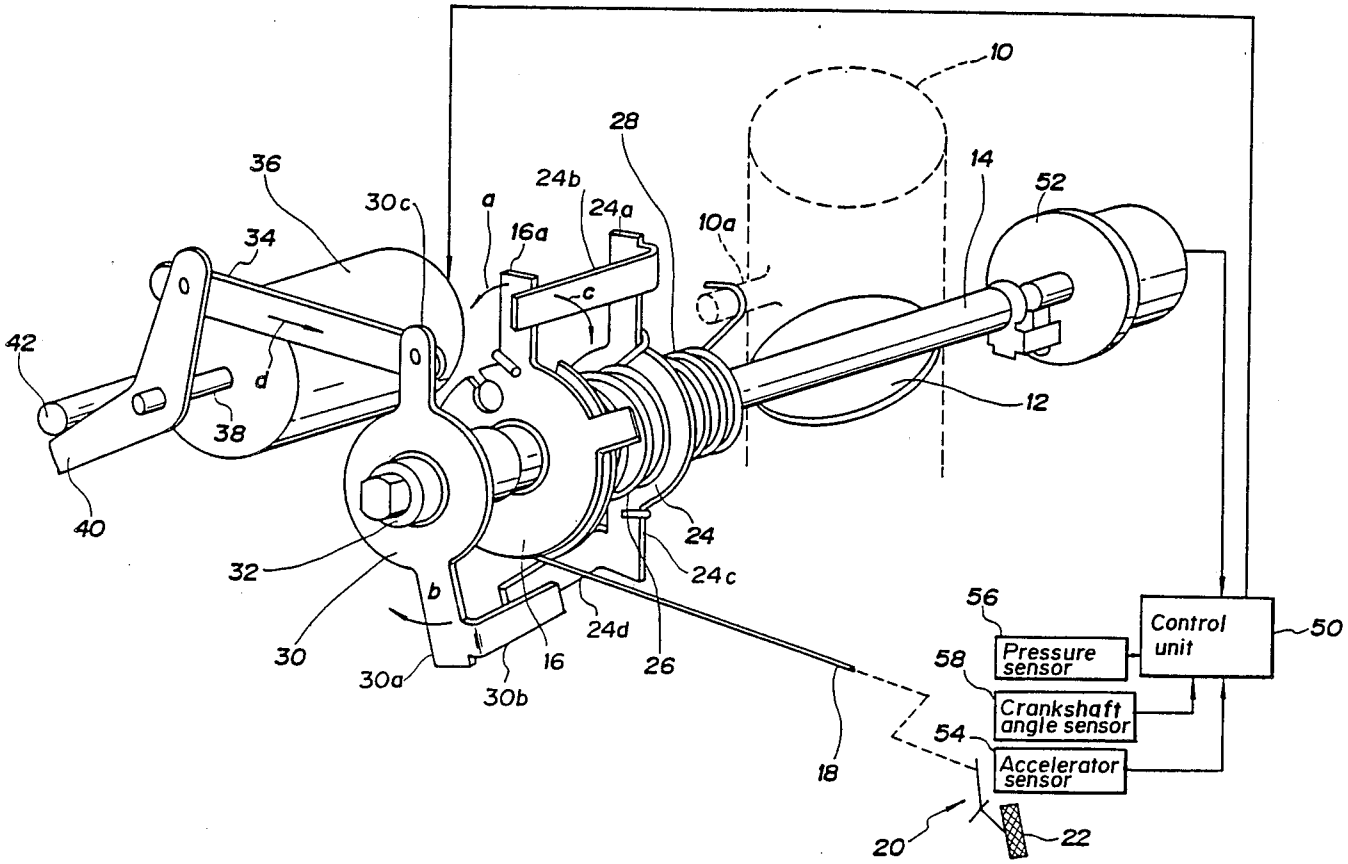
FIG. 7 (PRIOR ART)
FIG. 7 is a schematic view, similar to FIG. 1, but shows a throttle control system according to the prior art.

The invention will now be explained with reference to an embodiment referring to the attached drawings. In the overall view of an embodiment of the invention shown in FIG. 1, parts analogous to those of the prior art device shown in FIG. 7 are assigned like reference symbols.

One point of difference between the system according to the present invention and the conventional system is that a second shaft 60 is provided in parallel with the throttle valve shaft 14 and has mounted thereon an accelerator drum 62 which is inserted in the linkage system i.e. the wire 18 and the linkage mechanism 20, between the throttle drum 16 and the accelerator pedal 22. More specifically, the end of the wire 18 is not connected to the throttle drum 16, but is connected to the accelerator drum 62 through a groove 64 formed therearound, and the arm 16*a* of the throttle drum 16 is lengthened to link with an arm 62*a* of the accelerator drum 62 by a second connecting rod 66. Further, a second return spring 70 having one end fastened to a fixed member 68 is mounted on the accelerator drum shaft 60 for urging the accelerator drum 62 in the direction of the arrow e, i.e. the clockwise direction in the figure. Therefore, in the system according to this invention, the structure is such that all or most of the force for urging the throttle valve 12 in the closing direction is provided by the second return spring 70. Since the accelerator drum 62 and the throttle drum 16 are linked by the second connecting rod 66, the force of the second return spring 70 is transmitted to the throttle valve 12 through the throttle drum 16, the spring 26 and the throttle lever 24, whereby the throttle valve 12 is urged in the closing direction either by this force alone or by this force in cooperation with the force of the first return spring 28. More specifically, since the valve closing force of relatively large magnitude was provided solely by the first return spring 28 in the prior art system, it was necessary to provide the spring 26 with a force greater than that of the first return spring 28. The result of this was the aforesaid undesirable variation in the amount of force required to depress the accelerator pedal.

Figure 2:
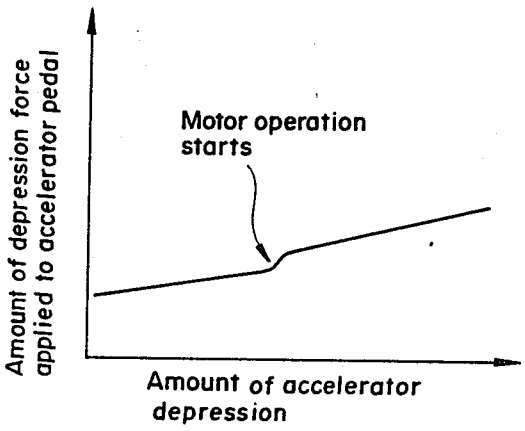
FIG. 2 is a graph for explaining the relation between the amount of accelerator depression and the amount of depression force applied to the accelerator pedal in the system according to this invention.

In contrast, in the present invention since the second return spring 70 is provided for supplying all or most of the valve closing force, the force of the first return spring 28 can be set very small and, for example, need only be large enough to close the throttle valve 12 should there be some malfunction which results in no force being applied to the throttle valve so that the force of the lost motion spring 26 can be similarly lessened to a great extent insofar as the relationship $M>L-B>C$ is satisfied. With the aforesaid structure, the force transmitted to the accelerator pedal and acting opposite to the depression force comes mainly from the main return spring 70. Namely, similarly to the case of the prior art system, the valve closing of the pulse motor 36 is carried out at the shaft 14 by the action between the throttle valve closing lever 30 and the throttle lever 24, since the second return spring 70 is provided on the accelerator drum shaft 60 which is a separate member from the shaft 14 and this spring has a high spring force capable of supplying all or most of the valve closing force, thus nearly all of the force acting on the accelerator pedal 22 in the direction opposite to the depressing force comes from second return spring 70 and is therefore of a fixed value. The force of the second return spring will thus absorb the weakened forces of the springs 26, 28 even if the forces are transmitted to the accelerator pedal. That is to say, as shown in FIG. 2, the amount of accelerator depressing force required remains substantially unchanged before and after the start of the pulse motor operation. Therefore, there is no change in the accelerator pedal feeling and the operator experiences no unnatural or uncomfortable feeling. Moreover, since L and B in the aforesaid relationship are set to small values, the value of M, i.e. the driving power of the pulse motor 36, can also be made small, meaning that it is possible to use a small motor and also to reduce the size of the motor lever 40 and other related members. As a result, though at a glance it would appear that the system according to the invention is more complex and bulkier than that according to the prior art, the fact is that from the viewpoint of overall system, that of the present invention is more compact and simpler.

Here it should be noted that in this invention the accelerator pedal depression sensor 54 is provided on the accelerator drum shaft 60 and the values detected by both this sensor and the throttle opening sensor 52 are sent to the control unit 50. The control unit 50 also receives the outputs of the intake air pressure sensor 56 and the crankshaft angle sensor 58 and on the basis of these input signals calculates a control value which it uses to drive the pulse motor 36, as before mentioned.

Figure 3:
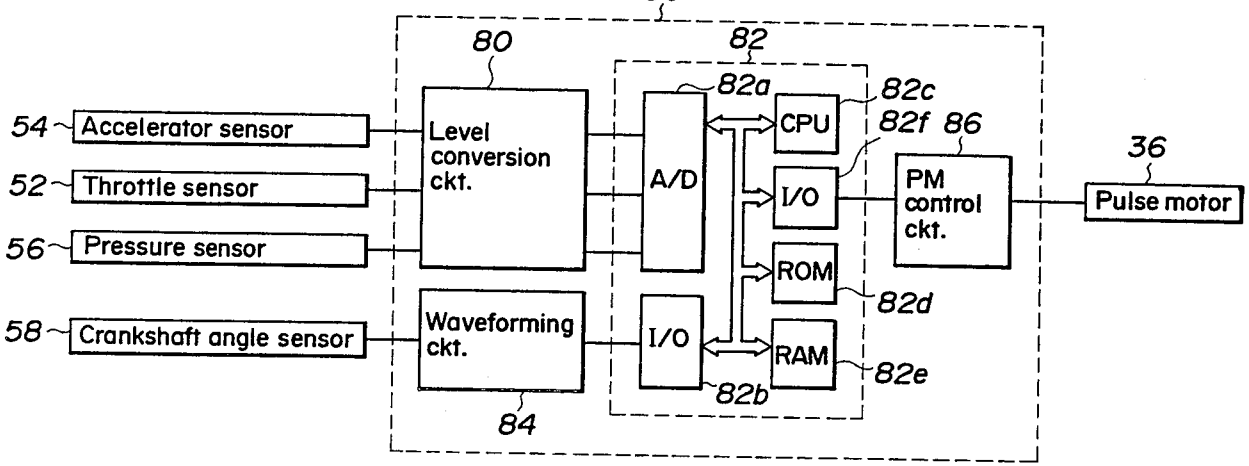
FIG. 3 is a block diagram of a control unit used in the system of FIG. 1.

Now referring to the control unit 50 shown in FIG. 3, it is provided with a level conversion circuit 80 for receiving and appropriately voltage-converting the outputs of the accelerator pedal depression sensor 54, the throttle opening sensor 52 and the intake air pressure sensor 56. The output of the level conversion circuit 80 is forwarded to a microcomputer 82 wherein it is successively digitalized by an A/D (analog/digital) converter **82*a* with a multiplexer. Further the signal output by the crankshaft angle sensor 58 is sent to a waveforming circuit 84 of the unit where it is waveformed and then input to the microcomputer 82 via an input I/O (input/output interface) 82*b*. The microcomputer 82 additionally has a CPU (central processing unit) 82*c*, a ROM (read-only memory) 82*d*, a RAM (random access memory) 82*e* and an output I/O 82*f*. The microcomputer 82 computes the engine speed from the signal output by the crankshaft angle sensor 58 and, based on the result of this computation and the other input parameters, computes a control value which it outputs to a pulse motor control circuit 86 for controlling the operation of the pulse motor 36**.

Figure 4:
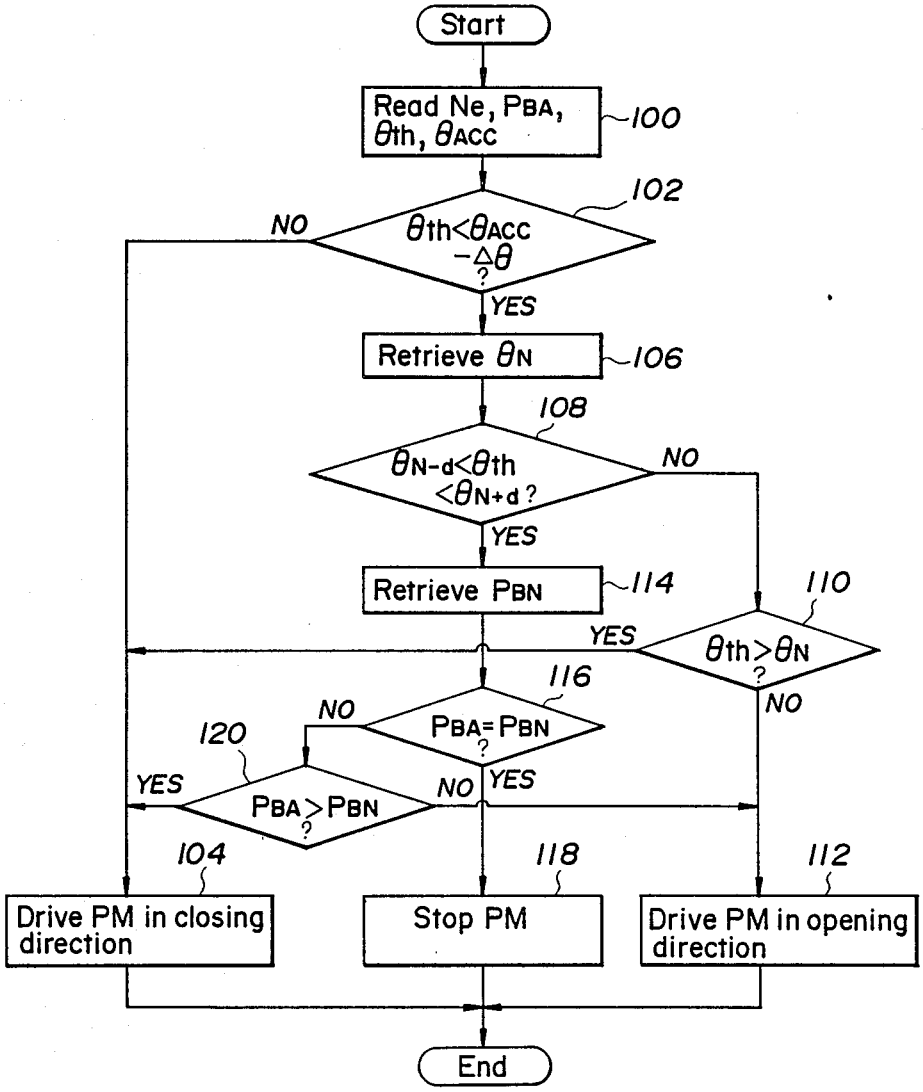
FIG. 4 is a flowchart showing the operation of the control unit of FIG. 3.

The operation of the control unit 50 will now be explained with respect to the flowchart of FIG. 4. The program represented by this flowchart is started at prescribed intervals.

Figure 5:
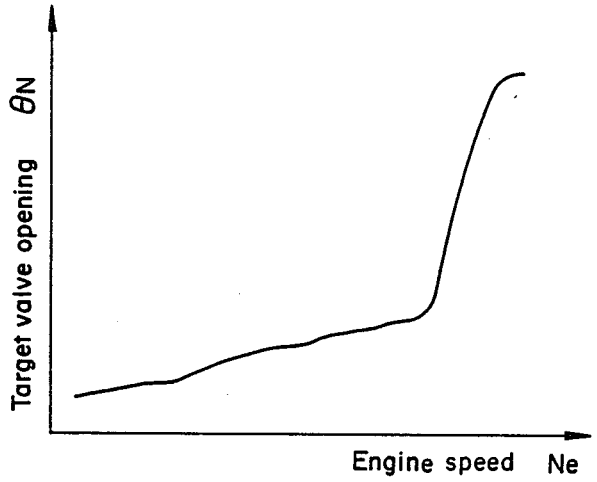
FIG. 5 is graph showing a characteristic curve used in the invention for retrieving the target throttle valve opening providing optimum fuel efficiency at the current engine speed.

First, in step 100, the engine speed Ne, the absolute intake air pressure PBA, throttle valve opening angle $\theta$th and the accelerator pedal angle $\theta$ACC are read out. Then in step 102, it is judged whether or not the throttle valve opening angle $\theta$th is smaller than a value obtained by subtracting a prescribed value delta $\theta$ (for example 0.5 degrees) from the accelerator pedal angle $\theta$ACC. If $\theta$th is larger than the value, since this means that the throttle opening angle is larger, a command for driving the pulse motor to close the throttle valve is output to the pulse motor control circuit 86 at step 104. If it is found that $\theta$th is smaller than the value, the target throttle valve opening $\theta$N which gives optimum fuel efficiency is retrieved at step 106 from the ROM **82*d* using the engine speed as address data. Data corresponding to the relationship between target valve opening and engine speed are shown by the characteristic curve of FIG. 5 which have been stored in the ROM 82*d* in advance. In the succeeding step 108, it is determined whether or not the throttle valve opening is within the range of permissible values with respect to the target valve opening $\theta$N and if it is not, the procedure moves to step 110 in which it is determined whether the throttle valve opening is larger than the target valve opening. If it is found that $\theta$th is larger than $\theta$N, a command for driving the pulse motor to close the throttle valve is output at step 104, while if it is found that $\theta$th is not larger than $\theta$N, a command for driving the pulse motor to open the throttle valve is output at step 112**.

Figure 6:
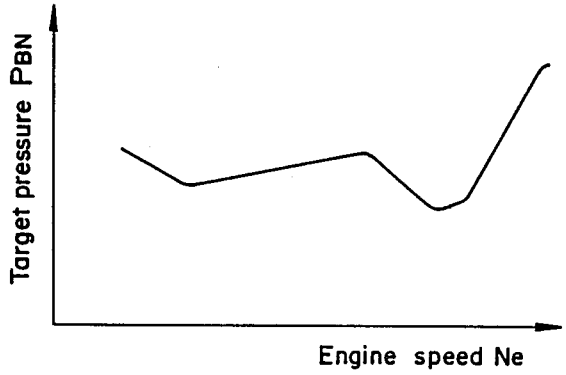
FIG. 6 is a graph similar to that of FIG. 5 but shows a characteristic curve used in the invention for retrieving the target intake air pressure providing optimum fuel efficiency at the current engine speed.
Figure 8:
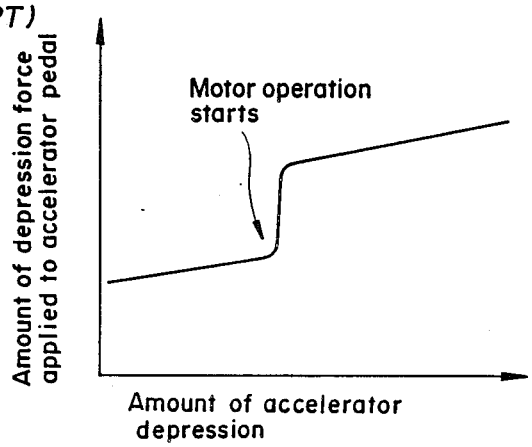
FIG. 8 (PRIOR ART)
FIG. 8 is a graph for explaining the relation between the amount of accelerator depression and the amount of depression force applied to the accelerator pedal in the prior art system.

On the other hand, if it is found in step 108 that the throttle valve opening $\theta$th is within th range of permissible values, the target intake air pressure PBN which similarly gives optimum fuel efficiency is retrieved at step 114 from the ROM using the engine speed as address data. Data corresponding to the relationship between the target pressure and engine speed are shown by the characteristic curve of FIG. 6 which have been also stored in the ROM in advance. In the succeeding step 116, it is determined whether or not the actual intake air pressure PBA is equal to the target air pressure PBN and if it is found that PBA equals to PBN, a command for discontinuing the driving of the throttle valve by the pulse motor is output at step 118 so as to maintain the condition, whereas if it is found that they are not equal, it is determined at step 120 whether the actual pressure PBA is larger than the target pressure PBN, and if it is found that PBA is larger than PBN, a command for driving the pulse motor to close the throttle valve is output at step 104. If it is found in Step 120 that PBA is smaller than PBN, a command for driving the pulse motor to open the throttle valve is output at step 112.

Again returning to FIG. 1, if the accelerator pedal 22 is depressed when the angular position of the pulse motor 36 is in the reverse direction from its proper position, the wire 18 will be pulled in the direction of the accelerator pedal 22, causing the accelerator drum 62 to rotate counterclockwise. The throttle drum 16 linked therewith will thus rotate in the direction of the arrow a and the throttle lever 24 will also move in the same direction under the force of the lost motion spring 26. As a result, the throttle valve 12 will be driven in the opening direction to a degree of opening equal to the accelerator pedal angle. On the other hand, when the pulse motor 36 rotates in the forward direction, the bar **30*b* of the throttle valve closing lever 30 abuts on the bar 24*d* of the throttle lever 24 and the throttle lever 24 rotates in the direction of the arrow c. As a result, the throttle valve 12 is driven in the closing direction without regard to the accelerator pedal angle, or else the rotation of the pulse motor 36 is stopped in response to a command for discontinuing the driving of the throttle valve by the pulse motor and the degree of valve opening at that time is maintained. In this case, owing to the provision of the accelerator drum shaft 60 and of the second return spring 70 thereon for providing all or most of the force for closing the throttle valve, change in the amount of force required for depressing the accelerator pedal before and after the start of the throttle valve closing operation by the pulse motor 36 can, as shown in FIG. 2**, be substantially prevented.

The present invention has thus been shown and described with reference to specific embodiments. However, it should be noted that the present invention is in no way limited to the details of the described arrangements but changes and modifications may be made without departing from the scope of the appended claims.

What is claimed is:

1. In a system for controlling the degree of opening of a throttle valve disposed in an air intake passage of an internal combustion engine mounted in a vehicle, including:

a rotatable shaft for rigidly supporting said throttle valve in the air intake passage;

first spring means for urging said shaft in the direction in which said throttle valve closes said air intake passage;

an accelerator pedal disposed adjacent at the operator's seat in the vehicle and linked with said shaft;

second spring means for urging said shaft in the opposite direction in which said throttle valve opens said air intake passage when said accelerator pedal is depressed, force of said second spring means being greater than that of said first spring means; and a motor connected to said shaft for driving said shaft in the valve closing direction counter to the force of said second spring means when actuated; the improvement comprising:

third spring means disposed in the linkage between said shaft and said accelerator pedal for urging said shaft in the valve closing direction in cooperation with said first spring means.

2. A system according to claim 1, wherein force of said third spring means is larger than that of said first spring means.

3. A system according to claim 2, further including:

a first drum rotatably mounted on said shaft;

a second shaft disposed by the side of said first shaft;

a second drum provided on said second shaft, said second shaft being connected to said accelerator pedal through said linkage and further to said first drum, said second drum being urged by said third spring means; and a lever rigidly fixed on said first shaft and urged by said second spring means to follow the rotation of said first drum, said lever being coupled with said motor when said motor rotates in the valve closing direction.

4. A system according to claim 3, further including a second lever rotatably mounted on said first shaft, said second lever being coupled to the drive shaft of said motor and having an arm which is engageable with an arm extending from said first lever to transmit the rotation of said motor to said first lever.

5. A system according to claim 4, wherein said first lever has a second arm extending therefrom to couple with said first drum.

6. A system according to claim 4, wherein said second lever is coupled to the motor through a rod.

7. A system according to claim 4, wherein said first and second drums are connected to each other through a rod.

* * * * *